United States Patent [19]

Deutsch

[11] 4,358,117

[45] Nov. 9, 1982

[54] LACROSSE STICK

[76] Inventor: Warren D. Deutsch, 33 Mill Dam Rd., Smithtown, N.Y. 11787

[21] Appl. No.: 288,061

[22] Filed: Jul. 29, 1981

[51] Int. Cl.[3] ..... A63B 59/02

[52] U.S. Cl. ..... 273/326

[58] Field of Search ..... 273/326, 73 C

[56] References Cited

U.S. PATENT DOCUMENTS

| | | | |
|---|---|---|---|
| 3,507,495 | 4/1970 | Tucker et al. | 273/326 |
| 4,097,046 | 6/1978 | Friant | 273/326 |
| 4,138,111 | 2/1979 | Rule | 273/326 |
| 4,270,756 | 6/1981 | Ahlenfeld et al. | 273/326 |

*Primary Examiner*—William H. Grieb

*Attorney, Agent, or Firm*—Marion C. Staves

[57] ABSTRACT

An improved lacrosse head having grooves along the outer surface of the scoop-shaped end adapted to protect the lacings of a net structure from abrasive contact. The grooves will be defined by (1) grooved depressions in the outer surface of the scoop-shaped end, or (2) pairs of raised ridges on the outer surface of the scoop-shaped end. The grooves will extend from the openings, through which the net structure is laced, to the edge of the frame to which the net is attached.

10 Claims, 6 Drawing Figures

LACROSSE STICK

FIELD OF INVENTION

This invention relates to an improved head for a lacrosse stick. More particularly this invention relates to an improved head for a lacrosse stick having grooves along the outer surface of the scoop-shaped end to protect the lacings of the net structure from abrasive contact.

BACKGROUND OF THE INVENTION

Lacrosse is a game which has been played for many hundreds of years. The game is scored by attempting to put a ball into the goal of the opposing team. The ball, of a hard elastomeric composition, is carried and tossed or thrown from a stick. As far back as can be determined, the sticks have been made of wood, usually hickory, shaped by hand by American and Canadian Indians, with whom the game originated. Up until rather recent times most lacrosse sticks were still made from solid wood and in the ancient handcrafting way.

Lacrosse sticks were in former times provided at one end with a crook and more recently with a bow forming a closed frame to which lacings are secured. The sticks have been traditionally strung by hand using leather, gut, synthetic cord or other materials to form the lacings. The pocket or net structure for throwing and catching the ball is formed by interweaving a combination of some of the above materials and attaching the resulting net structure to the frame through holes drilled or molded into the frame of the head. The net structure can then be adjusted by tightening and loosening the proper strings to obtain the desired playing characteristics.

More recently lacrosse sticks have been made with removable plastic heads as described in U.S. Pat. No. 3,507,495. Such plastic heads are more uniform and much less expensive to produce and repair then the traditional hardwood sticks. The net structure on traditional hardwood sticks or more modern sticks with plastic heads are almost universally attached with lacings in a manner that can subject the lacings to abrasion or even tearing. This problem is most serious where the lacings are attached to the frame in the scoop-shaped end of the head. During play, the scoop-shaped end often comes in contact with the ground, such as when a loose ball is scooped up, thus causing abrasion of the lacings. Also, contact with other sticks, during play or during "face offs" pulls and tears the lacings.

OBJECT AND GENERAL DESCRIPTION OF THE INVENTION

Accordingly, the object of this invention is to provide protection for the lacings on the head of a lacrosse stick.

Briefly, the aforesaid object is obtained by providing grooves along the outer surface of the scoop-shaped end into which the lacings fit. More particularly, there is provided an improved head for a lacrosse stick comprising a generally V-shaped frame having two side walls joined at a juncture and diverging therefrom, a transverse wall joining the ends of said side walls opposite of said juncture and forming a scoop-shaped end of the frame, said frame having a plurality of openings through the side walls and transverse wall to accommodate the attachment of a laced net structure to one side of the frame; wherein the improvement comprises a plurality of grooves along the outer surface of the transverse wall and extending from each opening in the transverse wall to the edge of the frame intended to be provided with the laced net structure, the width of said grooves being substantially equal to the width of the openings through the transverse wall and the depth of said grooves being at least about the thickness of the lacing on the laced net structure. The term "width of the openings through the transverse wall" appearing in the specification and claims shall mean the width of the opening in the direction substantially normal to the direction defined by the lacing as it passes through the opening.

According to one embodiment of the invention the grooves are merely depressions cut or more preferably molded into the outer surface of the transverse wall.

According to another embodiment of the invention the grooves are defined by pairs of raised ridges on the outer surface of the transverse wall. Where the grooves are defined by raised ridges, the bottom of the grooves can be flush with the outer surface of the transverse wall or below the surface of the transverse wall. The pairs of ridges will normally extend from opposite sides of the openings to the edge of the frame. However, for added protection, the ridges may be extended to encircle the openings thus forming U-shaped ridges.

DRAWINGS AND DETAILED DESCRIPTION

Figure 1:
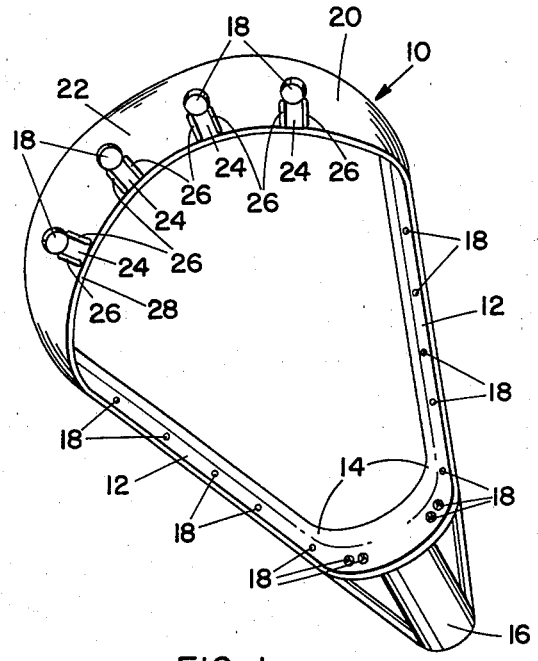
FIG. 1 is a perspective view of the back of the head of the lacrosse stick of this invention, the net structure being omitted.

Referring to FIG. 1, there is shown a head for a lacrosse stick including the improvement of this invention. The head (10) is, in general, a closed frame-like construction (20), V-shaped and substantially symmetrical. From the lower end or juncture (14) of the head (10), two side walls (12) diverge upwardly and outwardly. The upper ends of the side walls (12) are connected by a transverse wall (22), which forms a scoop-shaped end of the frame (20). Such scoop-shape is desirable for facilitating the fielding of ground balls. Immediately adjacent to the juncture (14), the head (10) is provided with attachment means (16) to attach the head (10) to a suitable stick (not shown). The frame (20) of the head (10) is provided with a plurality of openings (18) through the side walls (12) and transverse wall (22) for the attachment of a laced net structure (not shown). The openings (18) through the side walls (12) may be smaller than the openings (18) through the transverse wall (22) since the lacings (not shown) attaching the net structure (not shown) to the side walls (12) are usually smaller than the lacings (not shown) attaching the net structure (not shown) to the transverse wall (22). The improvement of this invention is shown in FIG. 1 as four grooves (24) defined by four pairs of raised ridges (26) on the back or outer surface of the transverse wall (22). Each pair of raised ridges (26) extends from opposite sides of the openings (18) through the transverse wall (22) to the edge (28) of the frame (20) forming grooves (24) to accommodate the lacings (not shown) and protect such lacings from abrasive contact. The bottom of each groove (24) is flush with the outer surface of the transverse wall (22).

Figure 2:
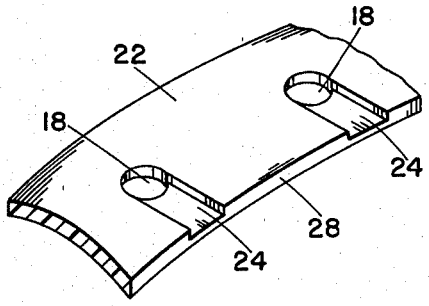
FIG. 2 is a perspective view of a cut away section of the back of the transverse wall of the head showing one embodiment of this invention.

The embodiment of FIG. 2 is a variation of the improvement of this invention. In FIG. 2 the grooves (24) are shown as depressions cut or molded into the outer surface of the transverse wall (22) extending from the openings (18) to the edge (28) of the frame.

Figure 3:
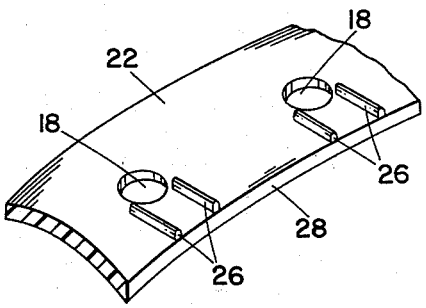
FIG. 3 is a perspective view of a cut away section of the back of the transverse wall of the head showing another embodiment of this invention.

The embodiment of FIG. 3 is the same embodiment shown in FIG. 1 except in greater detail and at a slightly different angle.

Figure 4:
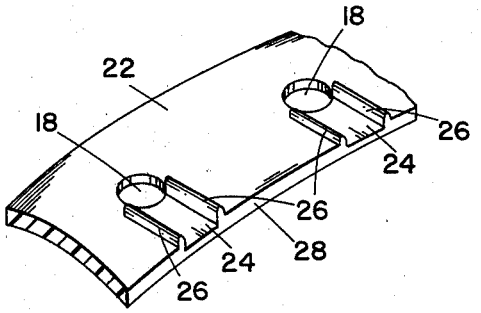
FIG. 4 is a perspective view of a cut away section of the back of the transverse wall of the head showing another embodiment of this invention.

The embodiment of FIG. 4 is another variation of the improvement of this invention. In FIG. 4 the embodiments shown in FIG. 2 and FIG. 3 are combined so as to define the grooves (24) by both raised ridges (26) and slight depressions cut or molded into the surface of the transverse wall (22) between each pair of ridges (26). The pairs of ridges (26) with a depression between them extend from the openings (18) to the edge (28) of the frame.

Figure 5:
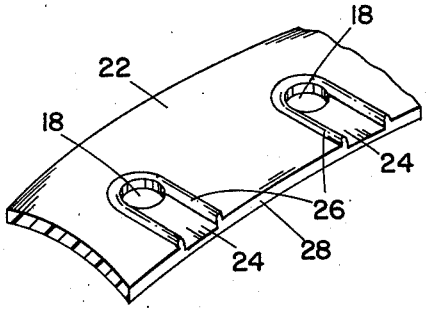
FIG. 5 is a perspective view of a cut away section of the back of the transverse wall of the head showing another embodiment of this invention.

The embodiment of FIG. 5 is a variation of the improvement shown in FIG. 4. In FIG. 5 each pair of raised ridges (26) joins to encircle an opening (18) through the transverse wall (22), forming a U-shaped ridge (26) and providing added protection for the lacings (not shown).

Figure 6:
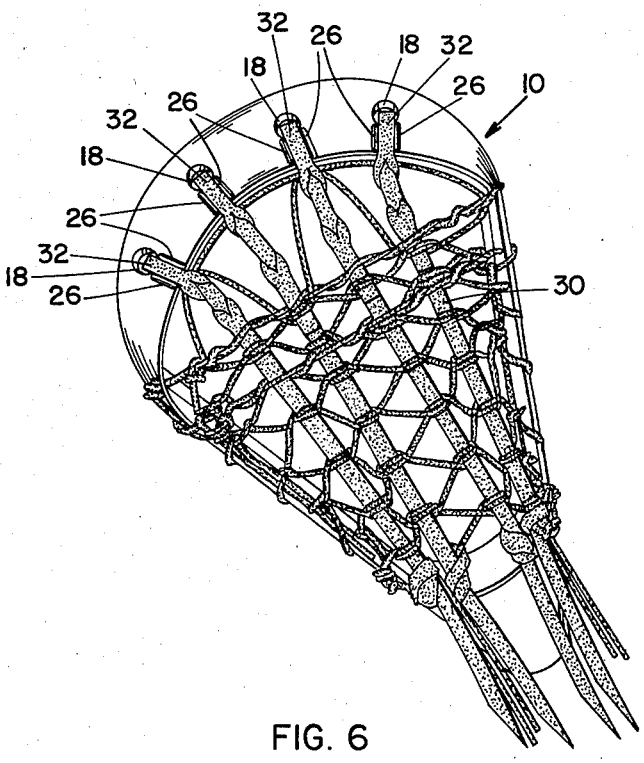
FIG. 6 is a perspective view of the back of the head of the lacrosse stick of this invention, the net structure being attached.

In FIG. 6 there is shown a head (10) for a lacrosse stick including the improvement of the present invention, as it would appear with a typical net structure (30) attached. In FIG. 6 the head (10) is provided with a typical net structure (30) attached by means of lacings (32) passing through the openings (18). The lacings (32) attached at the transverse wall (22) are accommodated in the grooves (covered by the lacings) which are defined by the raised ridges (26).

The lacrosse head can be of any dimensions without departing from the present invention, although specific standards are set forth by the rule making authorities for lacrosse heads to be used in Intercollegiate, Interscholastic and Professional league play. The lacrosse head can be manufactured from various materials such as wood, metal and plastic. Preferably most lacrose heads are made of plastic. Typical plastic materials which can be used to make the lacrosse heads are nylon, polypropylene, polyethylene terephthalate, epoxy polymers such as the reaction product of bisphenol A with epichlorohydrin, urethane elastomers such as those described in U.S. Pat. No. 3,507,495, etc. It may be desirable in certain cases to reinforce the plastic with reinforcing fibers such as glass fiber or graphite fiber. Usually the head will be molded but it could be laminated of a wood and polymer composite the way the better tennis racquets are made.

The grooves, which are the improvement of this invention, can merely be machined or cut into the surface of the scoop-shaped end of the frame. However, since cutting into the frame tends to weaken it, the grooves will preferably be molded at the time the frame is molded. Also, for purposes of strength, the grooves will generally have rounded edges and corners. Thus, the grooves, while essentially flat bottomed, will generally be more U-shaped than square. The openings through the scoop-shaped end can be of any shape, but will preferably be oval or round and have chamfered edges. Where the grooves are defined by raised ridges, the ridges can be applied to the surface of the frame, but will be much stronger if made integral with the frame. For purposes of strength, the ridges will generally have rounded edges.

The grooves will be essentially as wide as the lacings they are to protect. While the width can vary, it will most preferably be from about 3/16 to about ½ inch. The depth of the grooves will be at least about the thickness of the lacings. While the depth can vary, it will most preferably be from about 1/16 to about 3/16 of an inch deep. Where the grooves are defined by ridges, the ridges can vary in height and thickness, but will most preferably be from about 1/32 to about 3/16 of an inch high and from about 1/16 to about 3/16 of an inch wide.

Other features, advantages and specific embodiments of this invention will be readily apparent to those skilled in the art upon reading the foregoing disclosure. These modifications and others, being within the ability of one skilled in the art, are within the spirit of this invention and the scope of the appended claims.

What I claim is:

1. An improved head for a lacrosse stick comprising a generally V-shaped frame having two side walls joined at a juncture and diverging therefrom, a transverse wall joining the ends of said side walls opposite of said juncture and forming a scoop-shaped end of the frame, said frame having a plurality of openings through the side walls and transverse wall to accommodate the attachment of a laced net structure to one side of the frame; wherein the improvement comprises a plurality of grooves along the outer surface of the transverse wall equal in number to the openings through said transverse wall and extending from each opening in the transverse wall to the edge of the frame intended to be provided with the laced net structure, the width of said grooves being substantially equal to the width of the openings through the transverse wall and the depth of said grooves being at least about the thickness of the lacings on the laced net structure.

2. The improved head of claim 1 wherein the grooves are defined by a plurality of grooved depressions below the outer surface of the transverse wall.

3. The improved head of claim 1 wherein each groove is defined by a pair of raised ridges on the outer surface of the transverse wall, said ridges extending from opposite sides of the openings through the transverse wall to the edge of the frame intended to be provided with the laced net structure.

4. The improved head of claim 3 wherein the bottom of the groove is flush with the outer surface of the transverse wall.

5. The improved head of claim 3 wherein the bottom of the groove is below the outer surface of the transverse wall.

6. The improved head of claim 3 wherein the ridges of each pair of raised ridges join to encircle the opening through the transverse wall forming a U-shaped ridge.

7. The improved head of claim 3 wherein the raised ridges are integral with the transverse wall.

8. The improved head of claim 1 wherein the openings are circular.

9. The improved head of claim 1 wherein the width of the openings through the transverse wall are substantially equal to the width of the lacings.

10. The improved head of claim 1 wherein the number of openings through the transverse wall equals at least four.

* * * * *